US010838327B2

(12) United States Patent
Yasui

(10) Patent No.: US 10,838,327 B2
(45) Date of Patent: Nov. 17, 2020

(54) IMAGE HEATING APPARATUS HAVING A SEPARATION PLATE TO SEPARATE A SHEET FROM AN ENDLESS BELT

(71) Applicant: CANON KABUSHIKI KAISHA, Tokyo (JP)

(72) Inventor: Tatsuo Yasui, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/724,659

(22) Filed: Oct. 4, 2017

(65) Prior Publication Data

US 2018/0113405 A1 Apr. 26, 2018

(30) Foreign Application Priority Data

Oct. 20, 2016 (JP) ..... 2016-206241

(51) Int. Cl.
*G03G 15/20* (2006.01)

(52) U.S. Cl.
CPC . *G03G 15/2028* (2013.01); *G03G 2215/2035* (2013.01)

(58) Field of Classification Search
CPC ..... G03G 15/2028
USPC ..... 399/323, 329
See application file for complete search history.

(56) References Cited

U.S. PATENT DOCUMENTS

2011/0069984 A1* 3/2011 Watanabe ..... G03G 15/2028 399/67
2011/0211876 A1* 9/2011 Iwaya ..... G03G 15/2028 399/323
2012/0027478 A1* 2/2012 Tsukioka ..... G03G 15/2053 399/329
2012/0051805 A1* 3/2012 Suzuki ..... G03G 15/2028 399/323
2013/0236225 A1* 9/2013 Ogawa ..... G03G 15/2053 399/323
2013/0259544 A1* 10/2013 Ryu ..... G03G 15/2053 399/328
2014/0105634 A1* 4/2014 Tanaka ..... G03G 15/2042 399/90
2015/0168897 A1* 6/2015 Ogawa ..... G03G 15/2028 399/323

FOREIGN PATENT DOCUMENTS

CN 1044863 A 8/1990
CN 101900979 A 12/2010
(Continued)

*Primary Examiner* — Quana Grainger

(74) *Attorney, Agent, or Firm* — Canon U.S.A., Inc. I.P. Division

(57) ABSTRACT

An image heating apparatus includes an endless belt in contact with a toner image on a recording material, a separation member that separates the recording material from the endless belt, a regulation member that regulates a longitudinal position of the endless belt, and an interlocking mechanism. The interlocking mechanism interlocks a movement of an end portion of the separation member on the same side as a first edge of the endless belt with movement of the regulation member. The interlocking mechanism performs interlocking so that, when the regulation member moves toward an upstream in a conveyance direction, the end portion of the separation member moves toward the upstream in the conveyance direction.

9 Claims, 7 Drawing Sheets

(56) References Cited

FOREIGN PATENT DOCUMENTS

| | | | | |
|---|---|---|---|---|
| CN | 104345618 | A | | 2/2015 |
| JP | 2013-148730 | A | | 8/2013 |
| JP | 2014145829 | A | * | 8/2014 |
| JP | 201528527 | A | | 2/2015 |

* cited by examiner

IMAGE HEATING APPARATUS HAVING A SEPARATION PLATE TO SEPARATE A SHEET FROM AN ENDLESS BELT

BACKGROUND OF THE INVENTION

Field of the Invention

The present disclosure relates to an image heating apparatus for heating an image formed on a recording material.

Description of the Related Art

Conventionally, an image forming apparatus such as an electrophotographic apparatus and an electrostatic recording apparatus forms a toner image on a sheet and then heats and pressurizes the image to fix it. In recent years, from a viewpoint of energy-saving promotion, a fixing apparatus (image heating apparatus) using a film heating method for heating an image via a fixing belt (hereinafter referred to as a fixing film or a film) having a low thermal capacity has been in practical use. The film heating method is known to provide a high heat transfer efficiency and a short apparatus activation time.

In the film heating method, a film is known to laterally deviate in a longitudinal direction of the film during rotation of the film. To regulate the longitudinal position of the film, a regulation member is often disposed at the position facing an edge face of the film. This regulation member has a portion facing the inner circumferential surface of the film, and a function of stabilizing a rotational orbit of the film.

If the film rotates in a state where the edge face of the film abuts on the regulation member, sliding between the edge face of the film and the regulation member may possibly cause wear of the film accompanied by durability degradation. Japanese Patent Application Laid-Open No. 2015-28527 discusses a configuration including a mechanism for moving the position of the film by moving a portion facing the inner circumferential surface of the film to an upstream side in a recording material conveyance direction when the film laterally deviates. In the configuration discussed in Japanese Patent Application Laid-Open No. 2015-28527, when the film laterally deviates, the film position is moved to the upstream side in the recording material conveyance direction to reduce the force with which the film abuts on a regulation member.

On the other hand, generally, a fixing apparatus using a film heating method may be provided with a separation plate (separation member) to separate a recording material with an image fixed thereon from the surface of the film. The separation plate is disposed separately from the film surface across a minute gap.

In the configuration discussed in Japanese Patent Application Laid-Open No. 2015-28527, as the film is moved to the upstream side of the film in the recording material conveyance direction, the gap between the film and a separation guide increases, possibly resulting in a separation failure of the recording material.

SUMMARY OF THE INVENTION

The present disclosure is directed to work towards preventing an occurrence of a separation failure in an image heating apparatus having a mechanism for moving a film (a belt) to an upstream side in a recording material conveyance direction when the film (the belt) laterally deviates.

According to an aspect of the present invention, an image heating apparatus includes an endless belt configured to heat a toner image on a recording material while being in contact with the toner image on the recording material at a nip portion, a rotary member configured to form the nip portion in collaboration with the endless belt, and rotate the endless belt, a separation member configured to face an outer circumferential surface of the endless belt across a gap, and separate a leading edge of the recording material passing through the nip portion from the endless belt, a regulation member having a regulating surface disposed to be able to abut on an edge face of a first edge of the endless belt in a longitudinal direction of the endless belt and configured to regulate a longitudinal position of the endless belt, and a facing surface disposed to face an inner circumferential surface of the first edge of the endless belt, a guide portion configured to guide the regulation member so that the regulation member moves toward an upstream in a conveyance direction of a recording material in response to a movement of the endless belt in a direction from a side of a second edge as another edge of the endless belt to a side of the first edge of the endless belt in the longitudinal direction and a movement of the regulating surface in a direction from the side of the second edge to the side of the first edge by the edge face of the first edge of the endless belt, wherein, with the movement of the regulation member toward the upstream in the conveyance direction, the facing surface moves the first edge of the endless belt toward the upstream in the conveyance direction, and an interlocking mechanism configured to interlock a movement of an end portion of the separation member on the same side as the first edge of the endless belt with the movement of the regulation member, wherein the interlocking mechanism performs interlocking so that, when the regulation member moves toward the upstream in the conveyance direction, the end portion of the separation member moves toward the upstream in the conveyance direction.

Further features of the present invention will become apparent from the following description of embodiments with reference to the attached drawings.

DESCRIPTION OF THE EMBODIMENTS

An embodiment will be described in detail below with reference to the accompanying drawings. Components described in the embodiment are to be considered as illustrative and not restrictive of the scope of the present disclosure.

[Configuration of Image Forming Apparatus]

Figure 1:
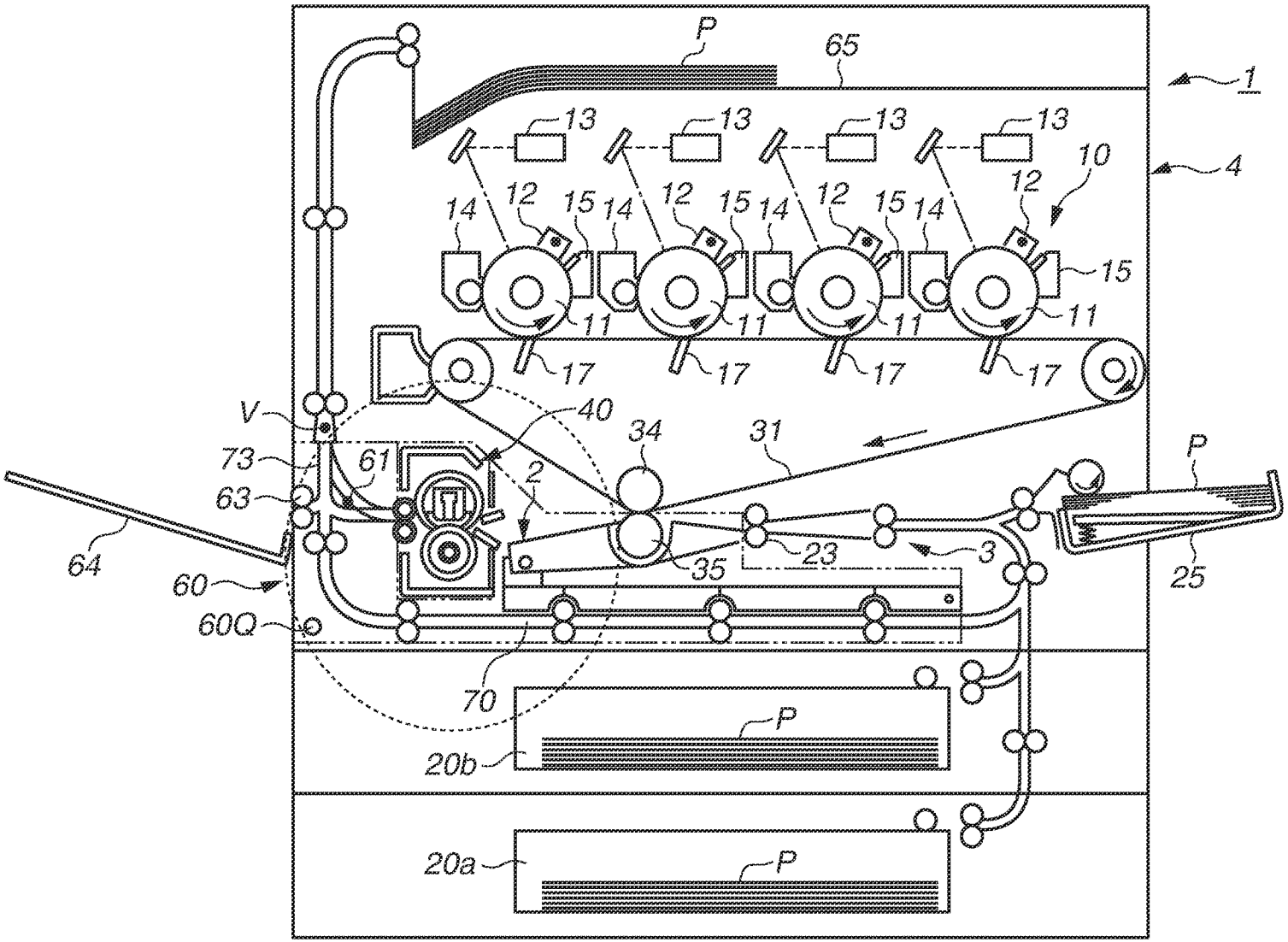
FIG. 1 illustrates an example of an image forming apparatus.

FIG. 1 illustrates an example of an image forming apparatus. FIG. 1 is a cross-sectional view illustrating an electrophotographic color printer as an example of an image forming apparatus when viewed from the front.

Although, in a present first embodiment, an image forming apparatus 1 having image forming units employing a full color intermediate transfer method will be described below, the image forming apparatus 1 is not limited thereto. For example, the image forming apparatus 1 may be an apparatus employing a direct transfer method for directly transferring an image from a photosensitive drum 11 to a recording material P without using an intermediate transfer belt 31 (described below), or an apparatus for forming a monochromatic toner image (for example, a monochrome apparatus). The image forming apparatus 1 may also be a copying machine, a printer, a facsimile machine, or a multifunction peripheral having a plurality of functions of these apparatuses.

The recording material P is a medium on which a toner image is formed by the image forming apparatus 1. Examples of the recording material P include plain paper, thick paper, and an overhead projector sheet. For convenience, the recording material (sheet) P will be described below using paper-related terms such as sheet supply, paper feed, paper discharge, a sheet supply portion, and a non-sheet supply portion, the recording material P is not limited to paper.

The image forming apparatus 1 illustrated in FIG. 1 includes image forming units 10 corresponding to the Y (yellow), M (magenta), C (cyan), and Bk (black) colors. More specifically, each of the image forming units 10 includes a photosensitive drum 11 as an image bearing member for bearing an electrostatic latent image on its surface, a charging device 12, a laser scanner 13, a developing device 14, a primary transfer blade 17, and a cleaner 15 for each of the Y, M, C, and K colors. The image forming units 10 form Y, M, C, and K toner images on the intermediate transfer belt 31 in a superimposed way.

An electrophotographic process of each image forming unit 10 for each color will be described below. The photosensitive drum (photosensitive member) 11 is pre-charged by the charging device (charging unit) 12. Then, when the photosensitive drum 11 is exposed to light corresponding to image data from the laser scanner (exposure unit) 13, an electrostatic latent image is formed on the photosensitive drum 11. The developing device 14 develops the electrostatic latent image on the photosensitive drum 11 with toner (developer). The toner image formed on the photosensitive drum 11 by the developing device 14 is primarily transferred onto the intermediate transfer belt 31 by the primary transfer blade (primary transfer unit) 17. After primary transfer, residual toner on the photosensitive drum 11 is removed by the cleaner (cleaning apparatus) 15.

Meanwhile, the recording material P is sent from a sheet cassette 20*a* in the first stage, a sheet cassette 20*b* in the second stage, or a multi-feed tray 25 to a registration roller pair 23.

The registration roller pair 23 once catches the recording material P and corrects skew of the recording material P. The registration roller pair 23 sends the recording material P to a secondary transfer nip portion in synchronization with the toner image on the intermediate transfer belt 31. The secondary transfer nip portion is formed by a secondary transfer roller (secondary transfer unit) 35 and a backup roller 34 via the intermediate transfer belt 31. The toner image on the intermediate transfer belt is transferred onto the recording material P by the secondary transfer roller 35.

Then, the recording material P is conveyed to a fixing apparatus (image heating apparatus) 40. The fixing apparatus 40 applies heat and pressure to the recording material P at a fixing nip portion N to fix the toner image onto the recording material P.

When forming a toner image only on one surface of the recording material P and when a toner image has been formed on a second surface in double-sided printing for forming toner images on both surfaces of the recording material P, the recording material P with toner images fixed thereon is discharged out of the image forming apparatus 1. More specifically, the recording material P with toner images fixed thereon is discharged to a discharge tray 64 disposed on a lateral face out of the image forming apparatus 1 via a discharge roller 63 through switching by a switching flapper 61. The recording material P with toner images fixed thereon may be discharged to a discharge tray 65 disposed on an upper face of the image forming apparatus 1.

The recording material P with a toner image fixed on a first surface in double-sided printing is upwardly guided by the switching flapper 61. When the trailing edge of the recording material P reaches an inverse point V, the recording material P is conveyed in a switchback way through a conveyance path 73 and front/back surface inversion is completed. The portion composed of the switching flapper 61 and the conveyance path 73 is an example of an inversion unit. Then, the recording material P is conveyed along the conveyance way 70, undergoes toner image forming on the second surface through a process similar to the toner image forming on the first surface, and is discharged to the discharge tray 64 or 65.

[Configuration of Fixing Apparatus]

A configuration of the fixing apparatus 40 will be described in detail below with reference to FIGS. 2 and 3.

Figure 2:
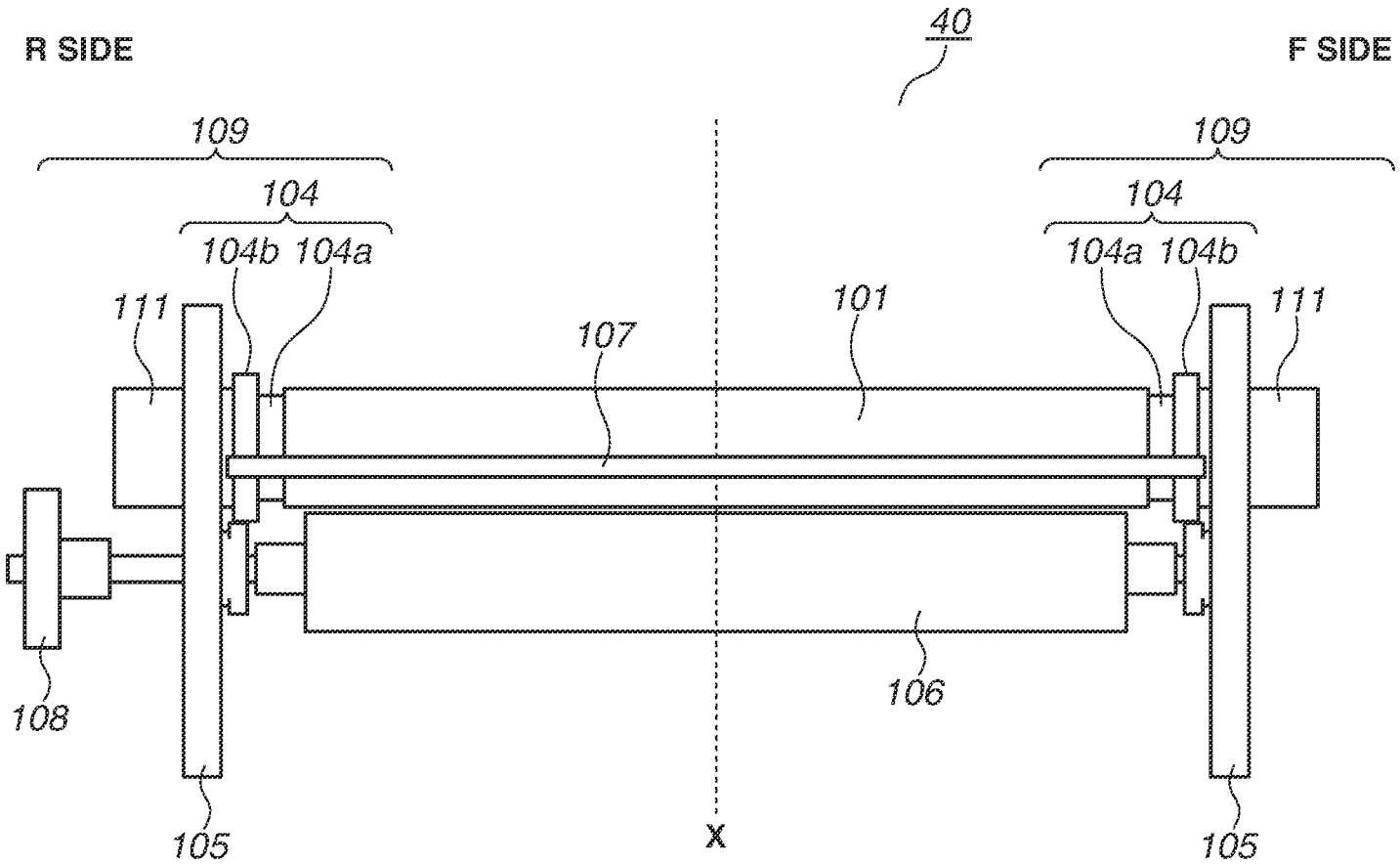
FIG. 2 illustrates an example of a fixing apparatus when viewed from a downstream side in a recording material conveyance direction.

FIG. 2 illustrates an example of a fixing apparatus when viewed from a downstream side in a recording material conveyance direction. FIG. 2 illustrates a state of the fixing apparatus 40 in a longitudinal direction, where an F side is a front side of the image forming apparatus 1 and an R side is a back side of the image forming apparatus 1.

Figure 3:
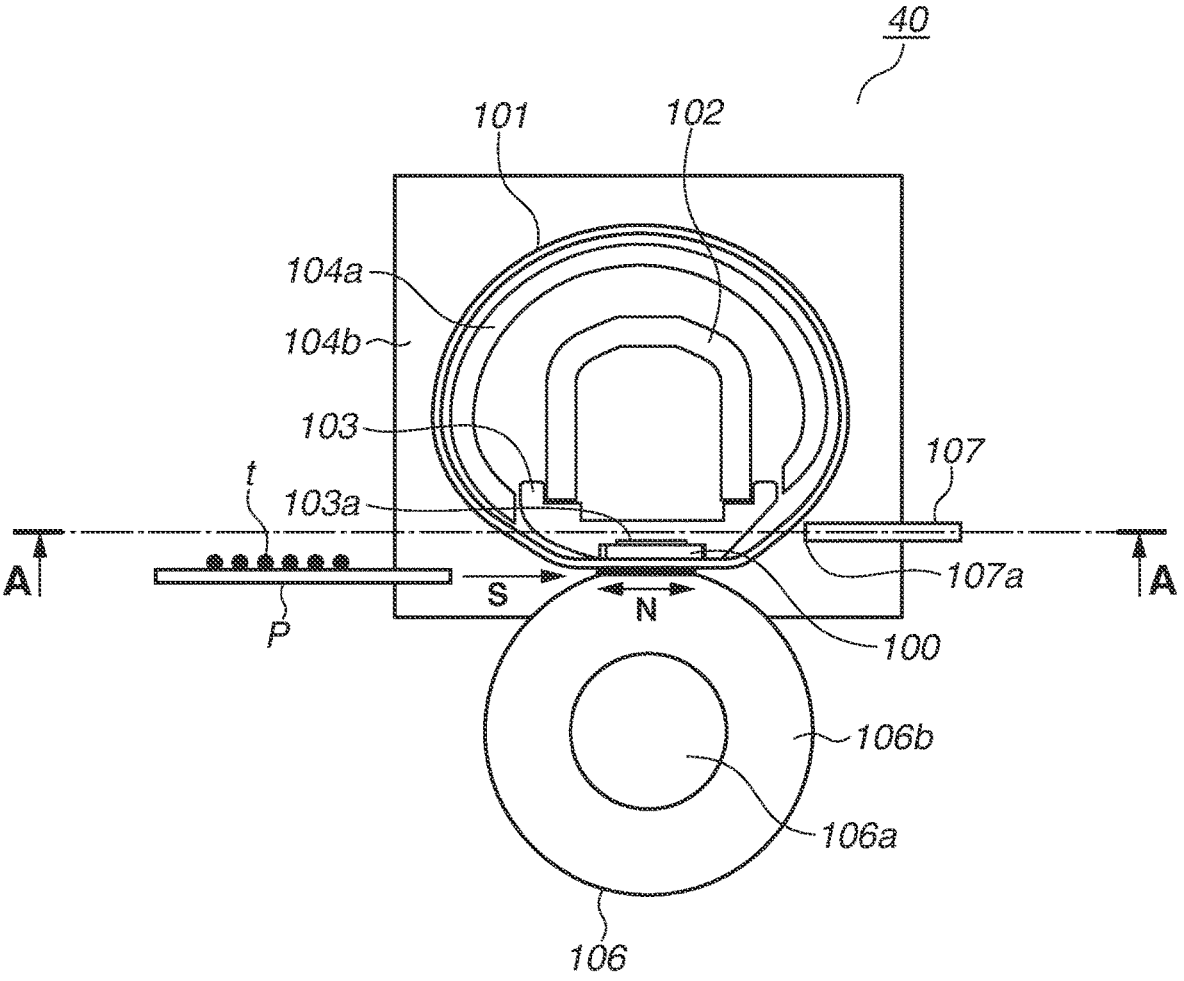
FIG. 3 is a cross-sectional view illustrating an example of the fixing apparatus.

FIG. 3 is a cross-sectional view illustrating an example of the fixing apparatus 40 when viewed from the R side illustrated in FIG. 2. An arrow S illustrated in FIG. 3 indicates a recording material P conveyance direction in the fixing apparatus 40.

As illustrated in FIG. 2, in the fixing apparatus 40, one edge (first edge) of a film 101 in a longitudinal direction is positioned on the F side of the fixing apparatus 40, and the other edge (second edge) of the film 101 in the longitudinal direction is positioned on the R side of the fixing apparatus 40.

The fixing apparatus 40 is a film heating type heating apparatus. The fixing apparatus 40 further includes a roller 106 as a rotary member, a ceramic heater 100 as a heating member, and the film (a belt) 101, which is cylindrical, as a fixing member (a fixing belt). The fixing apparatus 40 further includes a regulation member 104 at both ends of the film 101. The fixing apparatus 40 further includes, inside the film 101, a pad member 103 for forming a nip portion N with the roller 106 across the film 101, and a stay 102 for ensuring the strength of the pad member 103. The fixing apparatus 40 further includes a pressurization unit (for example, pressurizing spring) for applying pressure to the nip portion N. The pressurization unit is disposed at both ends of the fixing apparatus 40, respectively, in the longitudinal direction.

When the pressurization units apply pressure to holding members 111 disposed at both ends in the longitudinal direction, the holding members 111, the stay 102, and the pad member 103 are urged toward the roller 106. The fixing apparatus 40 further includes a separation member 107.

The roller 106 is composed of a core metal 106*a*, an elastic layer 106*b*, and a releasable layer in this order from an innermost side. The elastic layer 106*b* can be selectively made of a heat-resistant elastic material such as silicone rubber, fluorocarbon rubber, and fluororesin. For example, the releasable layer can be selectively made of a material having favorable mold-releasability and resistance to heat, such as fluororesin, silicone resin, fluorosilicone rubber, fluoro rubber, silicone rubber, perfluoro alkoxy alkane (PFA), polytetrafluoroethylene (PTFE), and tetrafluoroethylene-hexafluoropropylene copolymer (FEP). Bearing members (not illustrated) made of heat-resistant resin such as polyetheretherketone (PEEK), polyphenylene sulfide (PPS), and a liquid crystal polymer are attached at both ends of the core metal 106*a* in the longitudinal direction of the core metal 106*a*. The roller 106 is rotatably held with respect to side plates 105 of the fixing apparatus 40.

The roller 106 is connected to a motor (drive unit) via a gear 108 attached to an end of the roller 106 in the longitudinal direction, to be driven to rotate by the motor.

The film 101 is driven to rotate by the roller 106.

The ceramic heater 100 (hereinafter referred to as the heater 100) as a heating member for heating the film 101 is composed of an elongated sheet-like ceramic substrate extending along the longitudinal direction of the film 101, and a heating register layer disposed on the substrate. When the heating register layer is supplied with electricity, the temperature of the heating register layer rises with steep rising characteristics. The heater 100 is a low thermal capacity heater. The heater 100 is supported by being fit into a fitting groove 103*a* formed on the surface of the pad member 103 on the side of the roller 106. The fitting groove 103*a* is formed along the longitudinal direction of the film 101.

When the film 101 is heated by the heater 100, the film 101 heats the recording material P at the nip portion N. The film 101 is a cylindrical heat-resistant film and is also a flexible seamless film (an endless belt). The film 101 is composed of a base layer (for example, 0.04 mm thick) made of a metal such as stainless steel (SUS) and nickel, an elastic layer (for example, silicone rubber layer), and a releasable layer (for example, PFA resin tube) in this order from an innermost side.

The inner surface of the film 101 is not provided with a stretching roller, and the film 101 is not stretched.

The film 101 is respectively fit into an outside of the regulation members 104 at both ends in the longitudinal direction.

Each of the regulation members 104 is provided with an inner surface facing portion (facing surface) 104*a* facing an inner surface of the film 101, and an edge face regulation portion (regulating surface) (stopper portion) 104*b* for regulating a longitudinal position of the film 101 in a state where the regulation member 104 is fit into the inner side of the film 101. The inner surface facing portion 104*a* has a facing surface which faces the inner surface of the film 101 to guide a rotational orbit of the film 101. The edge face regulation portion 104*b* has a surface to be in contact with an edge face of the film 101 (when the film 101 moves in a thrust direction) to regulate the movement of the film 101 in the longitudinal direction.

The regulation member 104 is fit into the side plate 105 of the fixing apparatus 40. At each of both ends of the film 101, the regulation member 104 is engaged with an end of the assembly of the pad member 103 and the stay 102.

The pad member 103 comes in pressure contact with the roller 106 via the film 101 to form the nip portion N. The pad member 103 is a heat-resistant heat-insulation material made of phenol resin, polyimide resin, polyamide resin, polyamide imide resin, PEEK resin, poly ether sulfone (PES) resin, PPS resin, PFA resin, PTFE resin, and liquid crystal plastic (LCP) resin.

The stay 102 is pressed onto the back surface of the pad member 103 made of resin to provide the pad member 103 with the longitudinal strength.

The separation member 107 is a separation plate for separating the recording material P having passed through the nip portion N from the surface of the film 101. The separation member 107 is disposed at a position away from the outer circumferential surface of the film 101 by a predetermined distance. The material of the separation member 107 may be an alloy material of polybutylene terephthalate (PBT) and acrylonitrile-butadiene-styrene (ABS) resin, resin such as PPS and LCP, or a metal such as SUS formed in the shape of a plate, with the surface coated with fluorine.

[Lateral Deviation of Film]

Lateral deviation of the film 101 will be described below. There are some cases where the film 101 laterally deviates to one side of the film in the longitudinal direction during film rotation.

Examples of such cases include a case where an assembly tolerance causes a relative alignment deviation between the roller 106 and the film 101. More specifically, when attaching the regulation member 104 to the side plate 105, a tolerance in dimensions related to positioning may cause a deviation between the positions of the regulation members 104 on the F and the R sides in the recording material P conveyance direction. In this case, since the film 101 forms an intersecting angle with the roller 106, the film 101 is applied with a force in the longitudinal direction as the film rotates, laterally deviating in the longitudinal direction. In this case, the film 101 laterally deviates toward the regulation member 104 disposed more on the downstream side in the recording material P conveyance direction S with respect to the rotational axis of the roller 106 out of the regulation members 104 on the F and the R sides. More specifically, when the regulation member 104 on the F side is disposed more on the downstream side than the regulation member 104 on the R side in the recording material P conveyance direction S, the film 101 laterally deviates in the direction from the regulation member 104 on the R side to the regulation member 104 on the F side.

There are some cases where a lateral deviation is caused by factors other than a tolerance in assembly. Examples of such cases include a case where a deviation of the passage position of the recording material P in the longitudinal direction of the roller 106 causes a deviation in the temperature distribution in the longitudinal direction of the roller 106. Examples of such cases further include a case where a difference between pressurizing forces applied by the pressurization units disposed at both ends (R and F sides) in the longitudinal direction causes a deviation of the pressurizing force distribution in the longitudinal direction of the roller 106. In these cases, if a longitudinal deviation occurs in deformation of the roller 106 due to outer diameter thermal expansion or pressurization, a longitudinal deviation also arises in the rotational speed of the film 101 being driven by the roller 106, possibly resulting in a lateral deviation of the film 101. For example, when the rotational speed on the F side becomes higher than the rotational speed on the R side, the film 101 moves to the F side (for example, the direction of an arrow B illustrated in FIG. 4A) which is rotating at higher rotational speed.

When the film 101 laterally deviates toward the F side, an edge face 101*a* of the film 101 on the F side contacts the edge face regulation portion 104*b* of the regulation member 104 on the F side. If the film 101 rotates with the edge face 101*a* and the edge face regulation portion 104*b* in contact with each other, the edge of the film 101 may be possibly worn by a sliding motion between the edge face 101*a* of the film 101 and the edge face regulation portion 104*b*. In particular, if the edge face 101*a* of the film 101 strongly abuts on the edge face regulation portion 104*b*, the load on the film 101 due to the sliding motion increases, possibly resulting in durability degradation.

According to the present embodiment, the fixing apparatus 40 is provided, on the F side, with a displacement mechanism 109 for moving the position of the edge of the film 101 on the F side to an upstream side in the recording material P conveyance direction S when the film 101 laterally deviates to the F side. The displacement mechanism 109 moves the edge of the film 101 to the upstream side in the recording material P conveyance direction S to reduce the force with which the edge face 101*a* of the film 101 abuts on the edge face regulation portion 104*b*.

Also when the film 101 laterally deviates toward the R side, the load on the film 101 due to the sliding increases in a similar way to the lateral deviation to the F side, possibly resulting in durability degradation. For this reason, the fixing apparatus 40 according to the present embodiment is provided, also on the R side, with the displacement mechanism 109 for moving the position of the edge of the film 101 on the R side to the upstream side in the recording material P conveyance direction S when the film 101 laterally deviates to the R side.

[Configuration of Displacement Mechanism]

A configuration of the displacement mechanism 109 will be described in detail below with reference to FIGS. 4A and 4B.

Figure 4A:
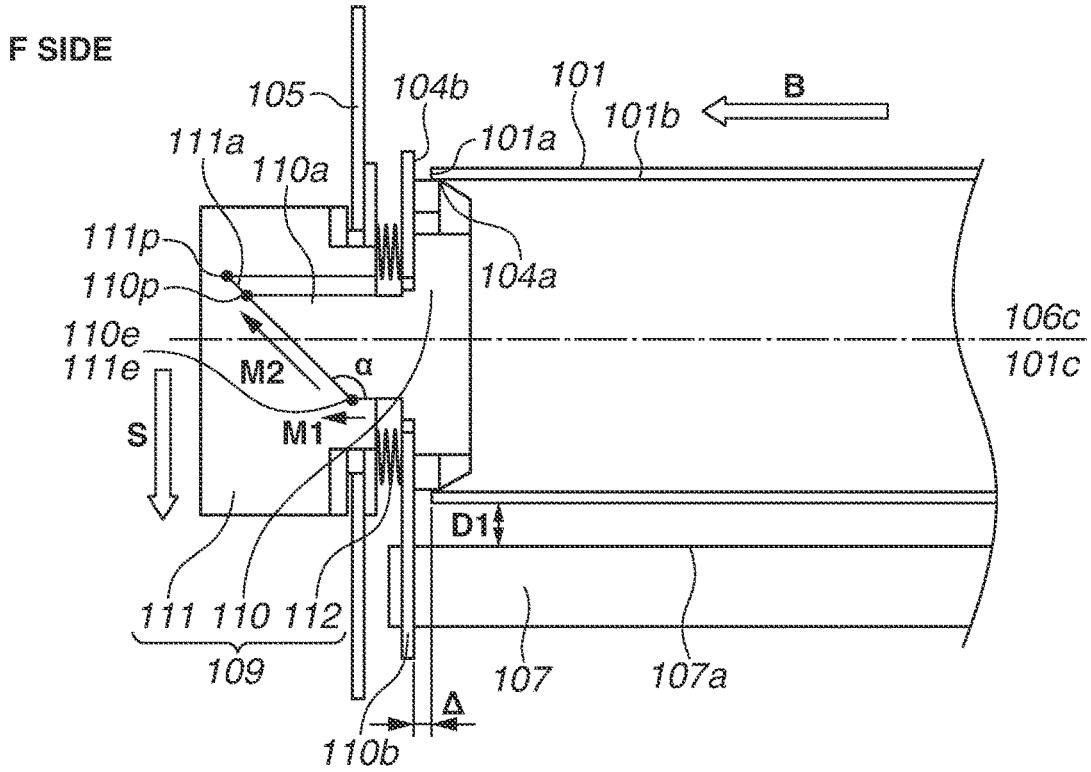
FIGS. 4A and 4B illustrate an example of a configuration of a displacement mechanism.
Figure 4B:
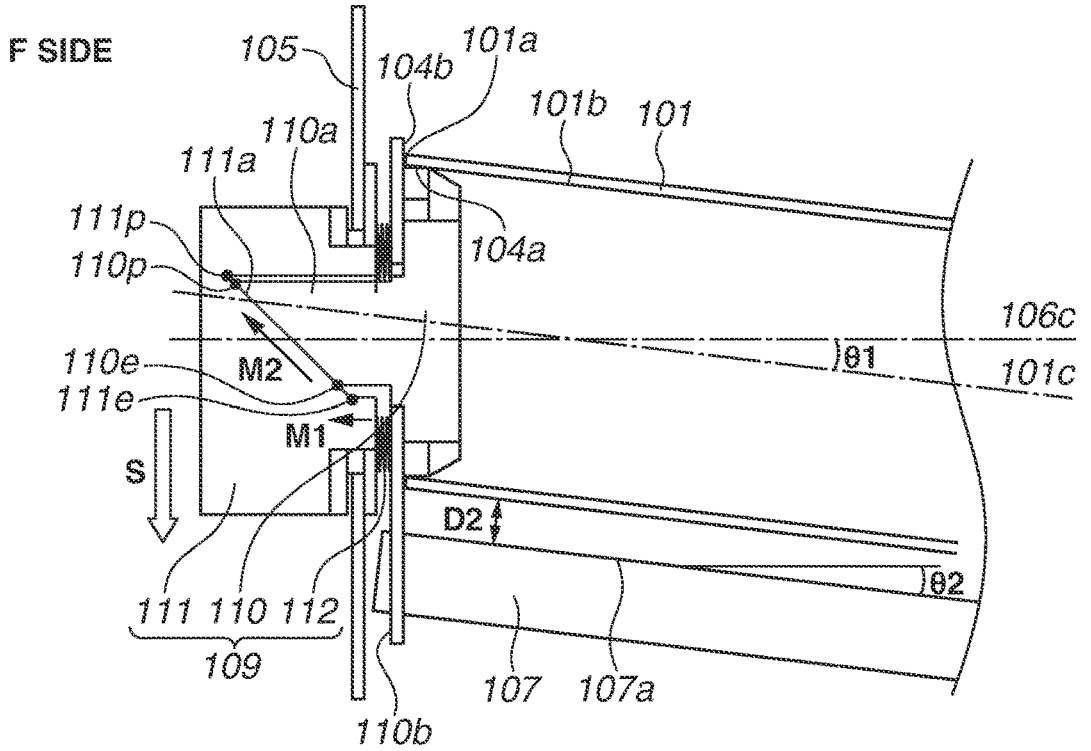

FIGS. 4A and 4B illustrate an example of a configuration of the displacement mechanism 109. FIGS. 4A and 4B are cross-sectional views taken along the dotted line A-A illustrated in FIG. 3, i.e., FIGS. 4A and 4B illustrate the fixing apparatus 40 viewed from the side of the roller 106.

The displacement mechanism 109 is disposed at both ends of the film 101 in the longitudinal direction. The displacement mechanisms 109 on the R and the F sides have approximately symmetrical shapes and functions with respect to the dotted line X as a conveyance reference for the recording material P illustrated in FIG. 2. Therefore, the following describes the displacement mechanism 109 on the F side with reference to FIGS. 4A and 4B, and descriptions of the displacement mechanism 109 on the R side (opposite side) will be omitted.

The displacement mechanism 109 includes the regulation member 104, a movable member 110, a holding member 111 for holding the movable member 110, and a compression spring (urging member) 112 for urging the movable member 110.

The holding member 111 is fit into (and fixed to) the side plate 105 of the fixing apparatus 40. Therefore, the position of the holding member 111 in the longitudinal direction of the fixing apparatus 40 and in the recording material P conveyance direction is fixed.

The movable member 110 is a part which movably engages with the holding member 111. The movable member 110 is provided with the above-described regulation member 104. More specifically, the movable member 110 has the edge face regulation portion 104*b* facing the edge face 101*a* of the film 101. As the film 101 laterally deviates in the direction of the arrow B illustrated in FIG. 4A, a gap Δ between the edge face 101*a* of the film 101 on the F side and the edge face regulation portion 104*b* decreases, and eventually the edge face 101*a* of the film 101 abuts on the edge face regulation portion 104*b*.

On the movable member 110, the regulation member 104 has the inner surface facing portion 104*a* facing the inner surface of the film 101 at the edge of the film 101. The inner surface facing portion 104*a* guides an inner surface 101*b* of the film 101 during rotation.

The movable member 110 has a convex portion 110*a* extending in the longitudinal direction of the film 101. The convex portion 110*a* has a tip portion 110*p* and an obtuse angle portion 110*e* with an angle α.

The holding member (guide member) 111 has a concave portion (guide portion) 111*a* in the longitudinal direction of the film 101. The concave portion 111*a* has an acute angle portion 111*p* at the concave 111*a* and an obtuse angle portion 111*e* with the angle α. As described below, the holding member 111 functions as a moving portion for moving the movable member 110 to the upstream side in the recording material P conveyance direction.

As illustrated in FIGS. 4A and 4B, the convex portion 110*a* of the movable member 110 is set in the concave portion 111*a* of the holding member 111. The compression spring 112 is disposed between the movable member 110 and the holding member 111. The compression spring 112 urges the convex portion 110*a* so that the tip portion 110*p* of the convex portion 110*a* of the movable member 110 moves away from the acute angle portion 111*p* of the concave portion 111*a* of the holding member 111. When the movable member 110 is applied with a force in a direction of an arrow M1 exceeding the urging force by the compression spring 112, the movable member 110 slides in a direction of an arrow M2 along with the concave portion 111*a* of the holding member 111.

[Operations of Displacement Mechanism Accompanying Lateral Deviation]

Operations of the displacement mechanism 109 will be described below. A case where the film 101 laterally deviates in the direction from the R side to the F side (the direction of the arrow B) will be described below with reference to FIGS. 4A and 4B.

FIG. 4A illustrates the displacement mechanism 109 in a state where the edge face 101*a* of the film 101 is not in contact with the edge face regulation portion 104*b*. When the edge face 101*a* of the film 101 is not in contact with the edge face regulation portion 104*b*, the obtuse angle portion 110*e* of the convex portion 110*a* of the movable member 110 urged by the compression spring 112 is at the position closest to the obtuse angle portion 111*e* of the concave portion 111*a* of the holding member 111.

FIG. 4B illustrates a state where the movable member 110 is applied with a force in the direction of the arrow M1 and slides in the direction of the arrow M2 along with the concave portion 111*a* of the holding member 111. The gap Δ between the edge face 101*a* of the film 101 and the edge face regulation portion 104*b* becomes zero, achieving a contact state.

When the film 101 laterally deviates toward the regulation member 104 on the F side (in the direction of the arrow B illustrated in FIG. 4A), the edge face 101*a* of the film 101 contacts the edge face regulation portion 104*b*. Since the regulation member 104 and the movable member 110 are integrally formed, the movable member 110 moves together with the regulation member 104. In a state where the edge face 101*a* of the film 101 contacts the edge face regulation portion 104*b*, when the film 101 further laterally deviates in the direction of the arrow B, the film 101 provides a force for pressing the edge face regulation portion 104*b*. If this pressing force exceeds the urging force by the compression spring 112, the film 101 presses the movable member 110 together with the regulation member 104 in the direction of the arrow M1. Accordingly, the convex portion 110*a* of the movable member 110 moves along with the concave portion 111*a* of the holding member 111, and the movable member 110 moves in the direction of the arrow M2. As a result, the movable member 110 moves to the upstream side in the recording material P conveyance direction S compared to the state illustrated FIG. 4A.

The inner surface 101*b* of the film 101 is in contact with the inner surface facing portion 104*a* of the movable member 110. Therefore, when the movable member 110 moves to the upstream side in the recording material P conveyance direction S, the inner surface facing portion 104*a* presses the inner surface 101*b* of the film 101. As a result, the edge of the film 101 on the side of the direction in which the film 101 has laterally moved (the F side illustrated in FIGS. 4A and 4B) moves to the upstream side in the recording material P conveyance direction S.

On the other hand, the edge face regulation portion 104*b* of the regulation member 104 on the R side (opposite side) of the film 101 in the longitudinal direction is disposed at a position where the edge face regulation portion 104*b* is not pressed by the edge face of the film 101 on the R side when the film 101 laterally deviates in the direction of the arrow B. Therefore, when the film 101 laterally deviates in the direction of the arrow B, the movable member 110 on the R side does not move to the upstream side in the recording material P conveyance direction S. Thus, a rotation center line 101*c* of the film 101 and a rotational axis 106*c* of the roller 106 form an angle θ1. When the film 101 is rotated by the roller 106 in the state illustrated in FIG. 4B, the film 101 is applied with a force for moving in the direction away from the movable member 110 on the F side (in the direction opposite to the direction of the arrow B illustrated in FIG. 4A). More specifically, the force applied to the edge face 101*a* of the film 101 is restricted. This works towards reducing wear of the film 101.

[Configuration of Separation Member]

Figure 5:
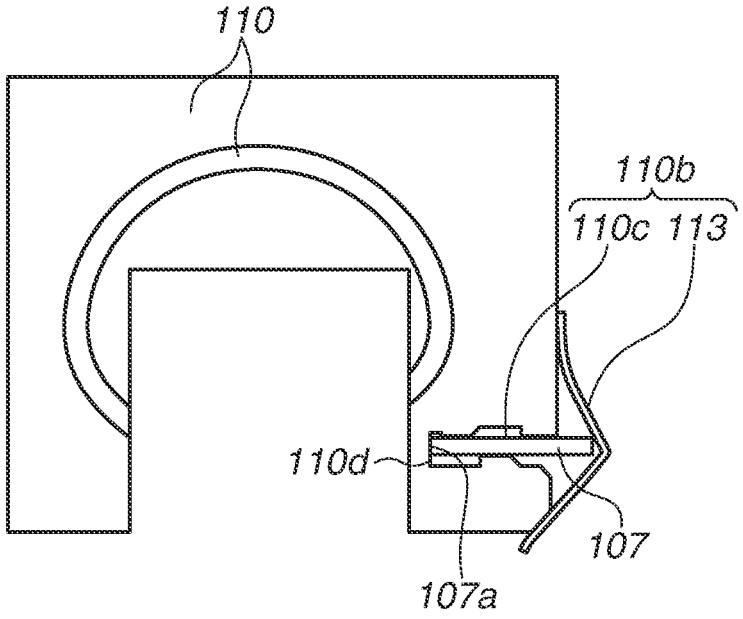
FIG. 5 illustrates an example of a supporting portion of a separation member.

The separation member 107 will be described in detail below with reference to FIGS. 3, 4A, 4B, and 5. FIG. 5 illustrates an example of a supporting portion of the separation member 107 when viewed from the R side illustrated in FIG. 2.

The separation member 107 is a separation plate for separating the recording material P having passed through the nip portion N from the film 101 to prevent the recording material P having passed through the nip portion N from winding around the film 101.

The recording material P is nipped and conveyed by the film 101 and the roller 106 at the nip portion N. When a toner image t on the recording material P is applied with heat and pressure at the nip portion N, the toner image t is fixed onto the recording material P. Then, the recording material P is conveyed by the rotation of the film 101 from the nip portion N to the downstream side in the conveyance direction. The recording material P is likely to stick to the surface of the film 101 by the toner image t melted at the nip portion N. If the portion on the recording material P for bearing the toner image t sticks to the surface of the film 101, the recording material P will be conveyed along the circumferential surface of the film 101 to the downstream side of the nip portion N in the conveyance direction. More specifically, the recording material P may possibly wind around the film 101.

The separation member 107 is disposed on the downstream side of the nip portion N in the recording material P conveyance direction. In consideration of a rotation locus of the film 101, the separation member 107 is disposed between the surface of the film 101 (outer circumferential surface) and a tip portion 107*a* of the separation member 107 across a predetermined gap to prevent the surface of the film 101 from being damaged by contact. Since there is a marginal area where the toner image t is not borne at a leading edge of the recording material P, the leading edge of the recording material P having passed through the nip portion N can abut on the separation member 107 without sticking to the surface of the film 101. The recording material P having abutted on the separation member 107 is guided by the separation member 107 to be separated from the surface of the film 101. More specifically, the separation member 107 separates from the film 101 the leading edge of the recording material P currently passing through the nip portion N.

According to the present embodiment, both ends of the separation member 107 in the longitudinal direction are supported by separation member supporting portions 110*b* disposed on the movable members 110. More specifically, the end of the separation member 107 on the R side is supported by the separation member supporting portion 110*b* of the movable member 110 disposed on the R side, and the end of the separation member 107 on the F side is supported by the separation member supporting portion 110*b* of the movable member 110 disposed on the F side.

As illustrated in FIG. 5, for example, the separation member supporting portion 110*b* includes a groove portion 110*c* formed on the movable member 110 and a leaf spring member (urging member) 113. The width of the groove portion 110*c* is formed to be slightly larger than the plate thickness of the separation member 107. The separation member 107 is fit into (and engaged with) the groove portion 110*c* while the separation member 107 is being slid in the direction in which the tip portion 107*a* of the separation member 107 moves toward a back end 110*d* of the groove portion 110*c*.

In a state where the separation member 107 is engaged with the groove portion 110*c*, the separation member 107 is urged toward the back end 110*d* of the groove portion 110*c* by the leaf spring member 113, and therefore the tip portion 107*a* of the separation member 107 constantly abuts on the back end 110*d* of the groove portion 110*c* with respect to the movable member 110. This prevents the separation member 107 from being dropped off from the groove portion 110*c*, and at the same time determines a position at the tip portion 107*a* of the separation member 107 relative to the movable member 110. More specifically, as illustrated in FIG. 5, the leaf spring member 113 urges the separation member 107 toward the upstream side in the recording material P conveyance direction to achieve a predetermined relative position between the separation member 107 and the movable member 110.

To follow the movement of the movable member 110, the separation member 107 is supported by the separation member supporting portion 110*b* so as to be slidable relative to the separation member supporting portion 110*b* in the longitudinal direction of the separation member 107. Even if the separation member 107 slides following the movement of the movable member 110 (to be described below), the separation member 107 does not drop off from the separation member supporting portion 110*b*.

The separation member 107 is supported by the separation member supporting portion 110*b* disposed on the movable member 110 in order to prevent a separation failure from occurring when the film 101 is moved by the displacement mechanism 109.

As described above, in the fixing apparatus 40 according to the present embodiment, the position of the film 101 may be moved to the upstream side in the recording material P conveyance direction S by the displacement mechanism 109. If the separation member 107 does not move while the film 101 is moving, the gap between the separation member 107 and the film 101 will increase. As a result, the recording material P passes through between the separation member 107 and the film 101, making it impossible to separate the recording material P.

According to the present embodiment, therefore, the end of the separation member 107 on the F side is supported by the separation member supporting portion 110*b* disposed on the movable member 110 on the F side. Thus, the movable member 110 on the F side is moved to the upstream side in the conveyance direction S by the displacement mechanism 109 on the F side, and at the same time, the end of the separation member 107 on the F side also moves to the upstream side in the conveyance direction S.

This operation also applies to the R side. More specifically, the end of the separation member 107 on the R side is supported by the separation member supporting portion 110*b* disposed on the movable member 110 on the R side. Thus, the movable member 110 on the R side is moved to the upstream side in the conveyance direction S by the displacement mechanism 109 on the R side, and at the same time, the end of the separation member 107 on the R side also moves to the upstream side in the conveyance direction S.

In this way, the gap between the film 101 and the separation member 107 increases to prevent a separation failure from occurring.

The above-described operation will be described in more detail below with reference to FIGS. 4A and 4B.

For example, a case where the movable member 110 in an initial state is as illustrated in FIG. 4A will be described below. More specifically, in the initial state, the rotation center line 101*c* of the film 101 is approximately in parallel with the longitudinal direction perpendicularly intersecting with the recording material P conveyance direction S, and the separation member 107 is disposed so that the tip portion 107*a* thereof becomes in parallel with the rotation center line 101*c*. Suppose that the displacement mechanism 109 is not subjected to a one-sided moving force (a force in a direction in which the edge face 101*a* of the film 101 presses the edge face regulation portion 104*b*) from the film 101. At this timing, a predetermined gap D1 is formed between the tip portion 107*a* of the separation member 107 and the surface of the film 101. According to the present embodiment, for example, the gap D1 is set to 0.5 mm.

Then, the film 101 laterally deviates in the direction of the arrow B illustrated in FIG. 4A, and the displacement mechanism 109 on the F side is applied with a one-sided moving force of the film 101. Then, the movable member 110 moves from the initial position to the upstream side in the recording material P conveyance direction S, as illustrates in FIG. 4B. At this timing, the angle θ1 formed between the rotation center line 101*c* of the film 101 and a rotational axis 106*c* of the roller 106 increases with the movement of the movable member 110.

Since the separation member 107 is supported by the separation member supporting portion 110*b* which integrally moves with the movable member 110, the separation member 107 also moves to the upstream side in the recording material P conveyance direction S together with the movable member 110.

An angle θ2 formed between the tip portion 107*a* of the separation member 107 and a direction parallel to the rotational axis 106*c* of the roller 106 also increases with the movement of the movable member 110. The angles θ1 and θ2 are approximately the same regardless of the amount of movement of the movable member 110.

As a result, the tip portion 107*a* of the separation member 107 maintains approximately in parallel with the rotation center line 101*c*. At this timing, the gap D2 formed between the tip portion 107*a* of the separation member 107 and the surface of the film 101 is approximately the same as the gap D1. More specifically, the separation member supporting portion 110*b* makes the movement of the separation member 107 follow up the movement of the movable member 110 to maintain a predetermined gap between the tip portion 107*a* of the separation member 107 and the surface of the film 101.

As described above, also when the film 101 moves to the upstream side in the recording material P conveyance direction S by an operation of the displacement mechanism 109, the separation member 107 also moves to the upstream side in the conveyance direction S together with the movable member 110. This works towards preventing the increase in gap between the film 101 and the tip portion 107*a* of the separation member 107. Therefore, a separation failure can be prevented from occurring by the movement of the film 101 by the displacement mechanism 109. More specifically, in an image heating apparatus having a mechanism for moving a film to the upstream side in the recording material conveyance direction when the film laterally deviates, a separation failure can be prevented from occurring.

Figure 6A:
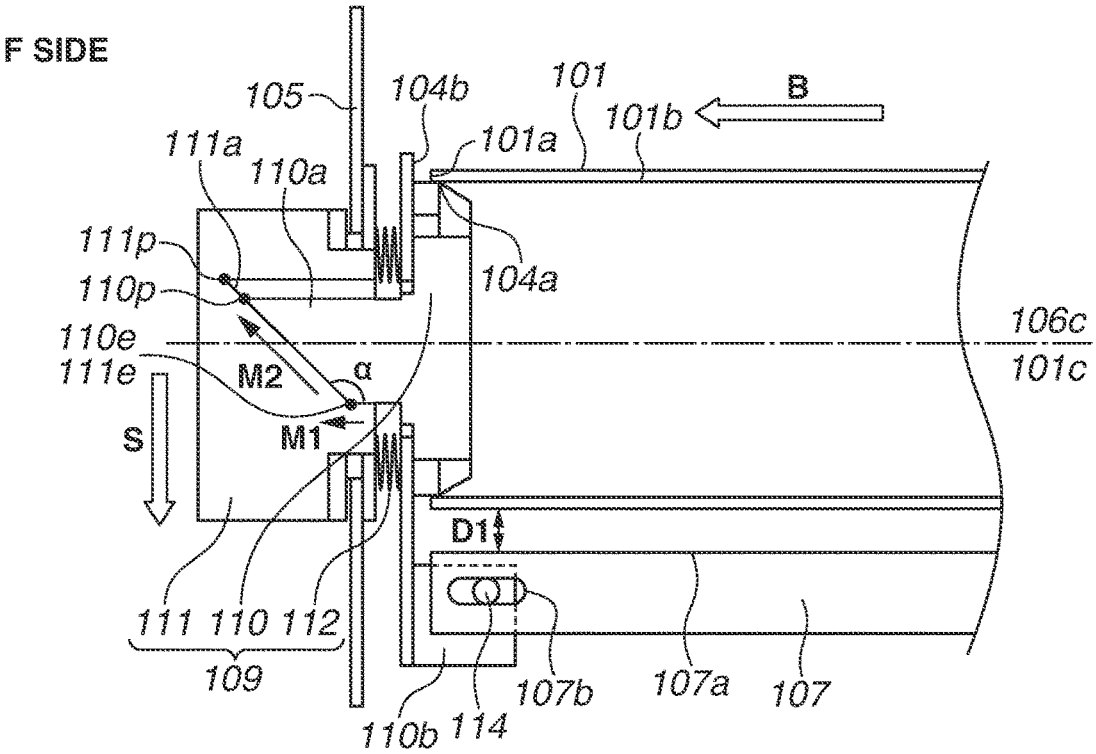
FIGS. 6A and 6B illustrate another example of a configuration of a displacement mechanism.
Figure 6B:
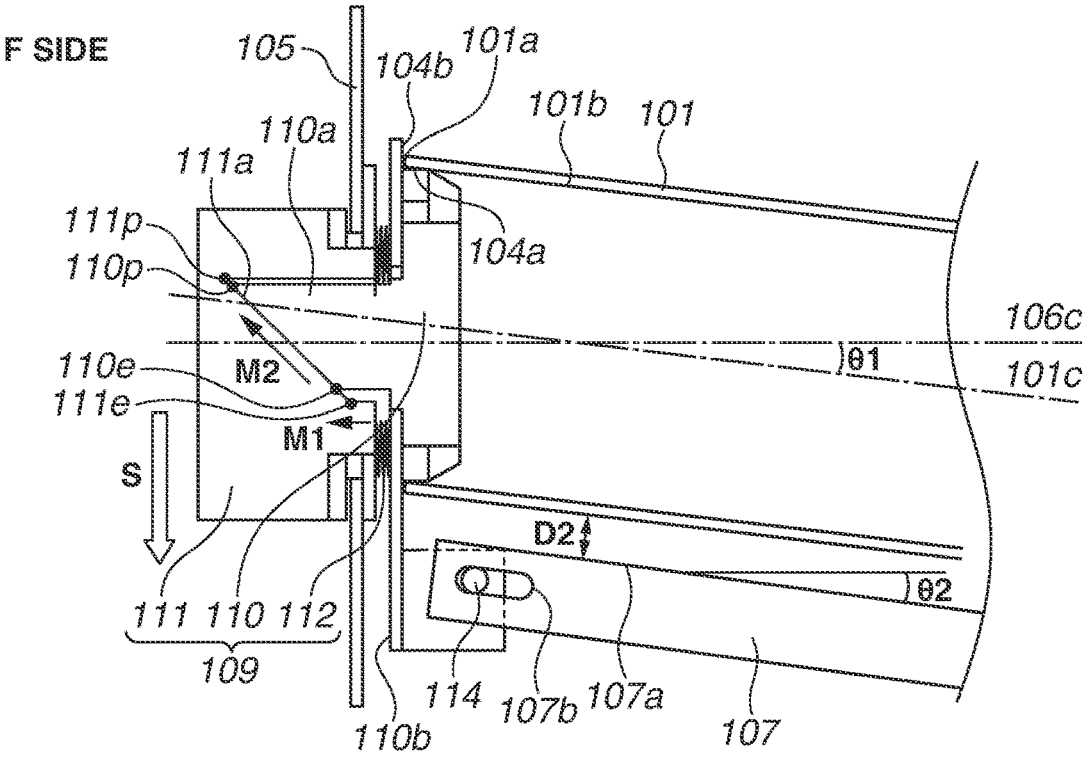
Figure 7:
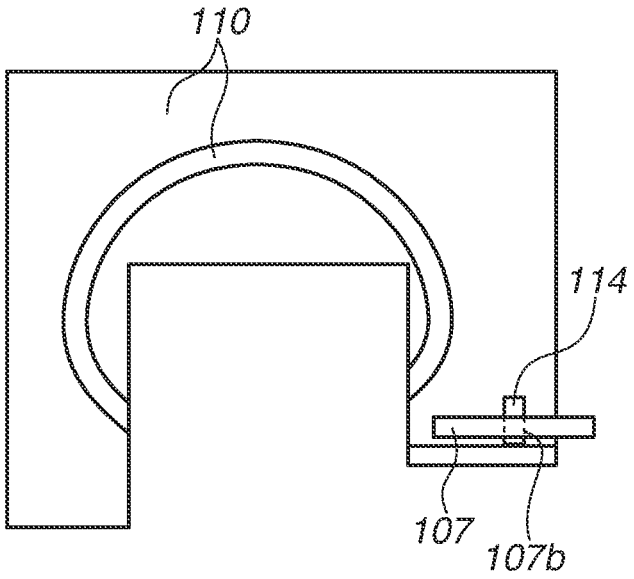
FIG. 7 illustrates another example of a supporting portion of a separation member.

A configuration according to a second embodiment will be described below with reference to FIGS. 6A, 6B, and 7. FIGS. 6A and 6B illustrate an example of a configuration of the displacement mechanism 109. FIG. 7 illustrates an example of a supporting portion of the separation member 107.

The separation member supporting portion (interlocking mechanism) 110*b* interlocks the movement of the separation member 107 with the movement of the movable member 110 to maintain a predetermined gap between the tip portion 107*a* of the separation member 107 and the surface of the film 101. The present embodiment is characterized in that the separation member supporting portion 110*b* is rotatably engaged with the separation member 107. Other configurations are similar to those according to the first embodiment and descriptions thereof will be omitted.

With the separation member supporting portion 110*b*, a pin-shaped protrusion 114 is formed in a direction perpendicular to the movable surface of the separation member 107 (more specifically, in a direction perpendicular to the plane formed by the moving directions M1 and M2 of the movable member 110). The protrusion 114 may be formed integrally with or separately from the movable member 110. The protrusion 114 is, for example, 1.5 mm in diameter and 3 mm in length. Although the separation member supporting portion 110*b* on the F side is illustrated in FIGS. 6A and 6B, the descriptions thereof also apply to the separation member supporting portion 110*b* on the R side.

On the other hand, an oblong hole portion 107*b* for engaging with the protrusion 114 is formed at the end of the separation member 107 in the longitudinal direction of the separation member 107. The hole portion 107*b* is, for example, 1.5 mm in width (a size in the widthwise direction of the separation member 107) and 5 mm in length (a size in the lengthwise direction of the separation member 107). The shape of the hole portion 107*b* to be engaged with the protrusion 114 is not limited to an oblong hole and may be a square hole or a round hole.

The width of the hole portion 107*b* is at least in size which fits the protrusion 114. The length of the hole portion 107*b* is made larger than the protrusion 114 so that the protrusion 114 is slidable in the longitudinal direction of the separation member 107. When the movable member 110 moves in the moving directions M1 and M2, the separation member 107 also rotates and slidably moves in the plane in the moving directions M1 and M2. More specifically, the separation member supporting portion 110*b* interlocks the movement of the separation member 107 with the movement of the movable member 110.

The above-described shapes of the separation member supporting portion 110*b* and the separation member 107 for engagement may be exchanged. More specifically, if an oblong hole is formed as the separation member supporting portion 110*b* and the protrusion 114 is formed on the separation member 107, similar effects to the above-described ones can be acquired. Even in this case, the separation member supporting portion 110*b* may be an oblong hole, a square hole, or a round hole.

Also in the fixing apparatus 40 according to the second embodiment, the above-described configuration allows obtaining similar actions and effects to the fixing apparatus 40 according to the first embodiment. More specifically, it is possible to prevent a separation failure from occurring in an image heating apparatus having a mechanism for moving a film to the upstream side in the recording material conveyance direction when the film laterally deviates.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-206241, filed Oct. 20, 2016, which is hereby incorporated by reference herein in its entirety.

What is claimed is:

1. An image heating apparatus comprising:

an endless belt configured to heat a toner image on a sheet at a nip portion;

a movable member including a support portion configured to rotatably support an inner surface of a longitudinal end of the endless belt, and a stopper portion configured to contact an edge face of the longitudinal end of the endless belt to stop a movement of the endless belt in a longitudinal direction of the endless belt;

a rotary member configured to rotate the endless belt and to form the nip portion co-operatively with the endless belt between the nip portion;

a separation plate configured to separate the sheet from the endless belt; and a holding member configured to hold the movable member, wherein the holding member includes a contact surface configured to lead the movable member toward an upstream of a conveyance direction of the sheet by a force received by the stopper portion from the endless belt by abutting against the movable member, and wherein the separation plate moves in conjunction with a leading operation leading the movable member toward the upstream along the contact surface.

2. The image heating apparatus according to claim 1, further comprising an urging member configure to transmit movement through the support portion to urge the separation plate toward the upstream side of the sheet conveyance direction.

3. The image heating apparatus according to claim 1, wherein the separation plate is disposed at a first distance from an outer surface of the endless belt, wherein, in a case where the separation plate is caused to move by movement of the movable member towards the upstream side of the sheet conveyance direction, the separation plate is disposed at a second distance from the outer surface of the endless belt, and wherein the second distance is approximately the same as the first distance so as to maintain a predetermined gap between the separation plate and the outer surface of the endless belt.

4. The image heating apparatus according to claim 1, further comprising an urging member configure to urge the stopper portion toward the edge face of the endless belt.

5. The image heating apparatus according to claim 1, wherein a positional relationship between the separation plate and an outer surface of the endless belt contributes to the separation plate separating the sheet from the endless belt, and wherein, even in a case where the separation plate is caused to move by movement of the movable member towards the upstream side of the sheet conveyance direction, the positional relationship between the separation plate and the outer surface of the endless belt continues to contribute to the separation plate separating the sheet from the endless belt so as to prevent an occurrence of sheet-endless belt separation failure.

6. The image heating apparatus according to claim 1, wherein the movable member moves towards the upstream side of the sheet conveyance direction in a case where force from the edge face pressing against the stopper portion exceeds a predetermined amount.

7. The image heating apparatus according to claim 1, wherein the holding member is fixed in place to the image heating apparatus.

8. The image heating apparatus according to claim 1, wherein the image heating apparatus is a film heating type heating apparatus.

9. The image heating apparatus according to claim 1, further comprising a surface heater configured to heat the endless belt by coming in contact with the endless belt, wherein the rotary member applies pressure to the surface heater through the endless belt.

* * * * *